US005778835A

United States Patent [19]

Vought

[11] Patent Number: 5,778,835

[45] Date of Patent: Jul. 14, 1998

[54] INTERNAL COMBUSTION ENGINE

[75] Inventor: Carl D. Vought, Huntsville, Ala.

[73] Assignee: Amtec Corporation, Huntsville, Ala.

[21] Appl. No.: 839,375

[22] Filed: Apr. 18, 1997

[51] Int. Cl.[6] ..... F02B 75/22

[52] U.S. Cl. ..... 123/55.5; 123/197.4

[58] Field of Search ..... 123/197.4, 55.5, 123/55.7

[56] References Cited

U.S. PATENT DOCUMENTS

| | | | |
|---|---|---|---|
| 1,713,759 | 5/1929 | Irwin | 123/55.7 |
| 2,234,900 | 3/1941 | Jones | 123/55.5 |
| 3,195,420 | 7/1965 | Johannsen | 123/55.5 |
| 3,946,706 | 3/1976 | Pailler | 123/55.7 |
| 4,078,439 | 3/1978 | Iturriaga-Notario | 123/55.7 |
| 4,763,619 | 8/1988 | Eitel | 123/55.5 |
| 5,150,670 | 9/1992 | Sadler | 123/196 R |
| 5,152,373 | 10/1992 | Callies | 123/196 R |
| 5,503,038 | 4/1996 | Aquino et al. | 123/55.5 |

*Primary Examiner*—David A. Okonsky

*Attorney, Agent, or Firm*—John C. Garvin, Jr.; James E. Staudt

[57] ABSTRACT

An internal combustion engine, having a compact eccentric crankshaft which permits a straight passage to be formed along the center of rotation of the crankshaft. When applied to a two cylinder engine the crankshaft design permits longitudinal alignment of opposing cylinders. The eccentric crankshaft is closely fitted within a compact crankcase to minimize crankcase volume.

13 Claims, 2 Drawing Sheets

INTERNAL COMBUSTION ENGINE

BACKGROUND OF THE INVENTION

1. Field of the Invention

The invention relates generally to an internal combustion engine, and more specifically to an internal combustion engine which provides a very compact eccentric crankshaft through which a straight passage may be formed along the center of rotation of the crankshaft. The eccentric crankshaft is closely fitted within a compact crankcase.

2. Description of Related Art

It has long been recognized that in internal combustion engines, as well as in electric motors, it is of great advantage to provide a drive shaft through which a straight passage may be formed along the center of rotation of the shaft. Such a passage may be utilized to accommodate a variety of useful devices. A pitch control for propellers, an engine speed control, and a governor control are examples of such devices. As illustrated in U.S. Pat. No. 1,779,050 to F. F. Schroder such a pitch control is a relatively simple mechanism when applied to an electric motor wherein the drive shaft is a straight hollow rod. However, as illustrated in U.S. Pat. Nos. 1,425,179 to A. Danielson, and 1,887,053 to R. Yates the problem of utilizing such a pitch control becomes quite complicated when the driving power is provided by an internal combustion engine. In Danielson, rather than attempt to provide a pitch control through the crankshaft of an engine, an independent and complex mechanism is attached to the engine. The Yates patent accepts the configuration of a conventional crankshaft and provides a complex pitch control system which forces metal balls through a tortuous passage formed in the crankshaft.

To overcome these and other shortcomings of the prior art, including the above cited patents, the present invention provides a unique internal combustion engine having a compact crankshaft and rod assembly which is housed in a similarly compact crankcase. The present invention also provides a crankshaft through which a straight passage may be formed, thus providing a path for a simplified actuator means for propeller pitch control devices, or other useful mechanisms.

In addition, it will be seen that the pre sent invention provides an internal combustion engine having an improved crankshaft and rod assembly which is stronger, more compact, more durable and less expensive to manufacture than conventional assemblies, and is inherently well balanced. Further, the compact design of this engine permits use of a crankcase of very small volume. This feature is required for optimum performance in crankcase supercharged engines such as those disclosed in U.S. Pat. Nos. 3,973,532, 4,475,499 and 5,279,269. The reduction of overall crankcase size also permits manufacture of a less expensive, lighter, and stronger crankcase with a minimum of material.

SUMMARY OF THE INVENTION

The eccentric crankshaft utilized in this invention is very compact and is particularly well suited for use in an engine which requires a crankcase having a minimum interior volume. While many advantages of this eccentric crankshaft are applicable to single cylinder engines, additional advantages are realized in two cylinder engine applications. The eccentrics of this crankshaft being quite thin and essentially co-located, counter balance each other, minimize the need for balancing counterweights, and also minimize its overall weight. Moreover, due to the close proximity of the two eccentrics upon which the connecting rods are mounted, the inertial forces developed by the masses of the rods and pistons also very nearly cancel each other. By incorporating a small offset in the wrist pin connection between each connecting rod and piston, the laterally opposing pistons and cylinders of a two cylinder opposed engine can be brought into exact longitudinal alignment, thereby canceling the inertial forces of the pistons, rings and wrist pins. This alignment of the cylinders also simplifies the structure that secures the cylinders to the crankcase. The unique and effective way in which forces are canceled in this design provides an inherently low vibration engine.

DESCRIPTION OF THE PREFERRED EMBODIMENT

Figure 1:
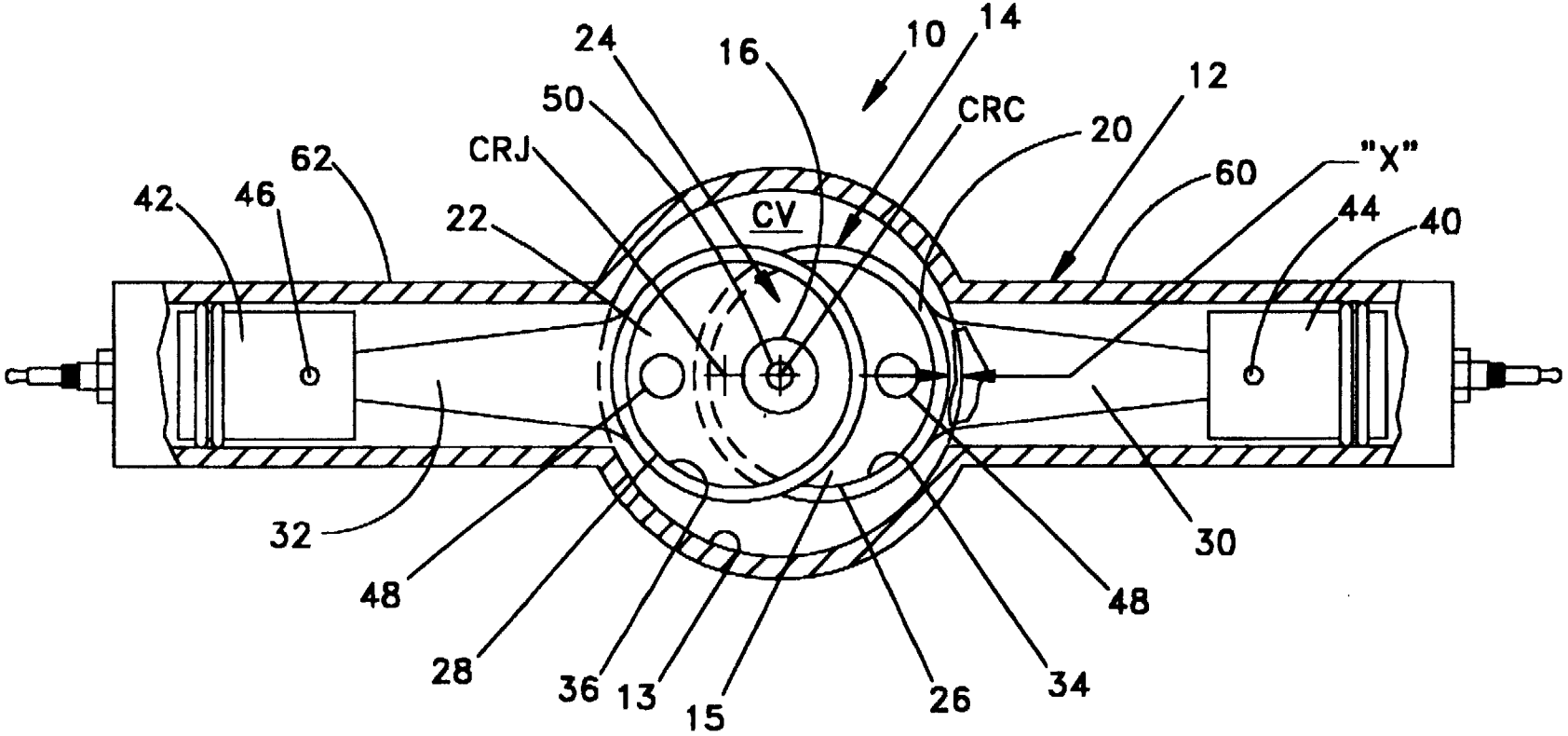
FIG. 1 is a sectional elevation illustrating an internal combustion engine with portions cut away to show pertinent internal parts thereof.
Figure 2:
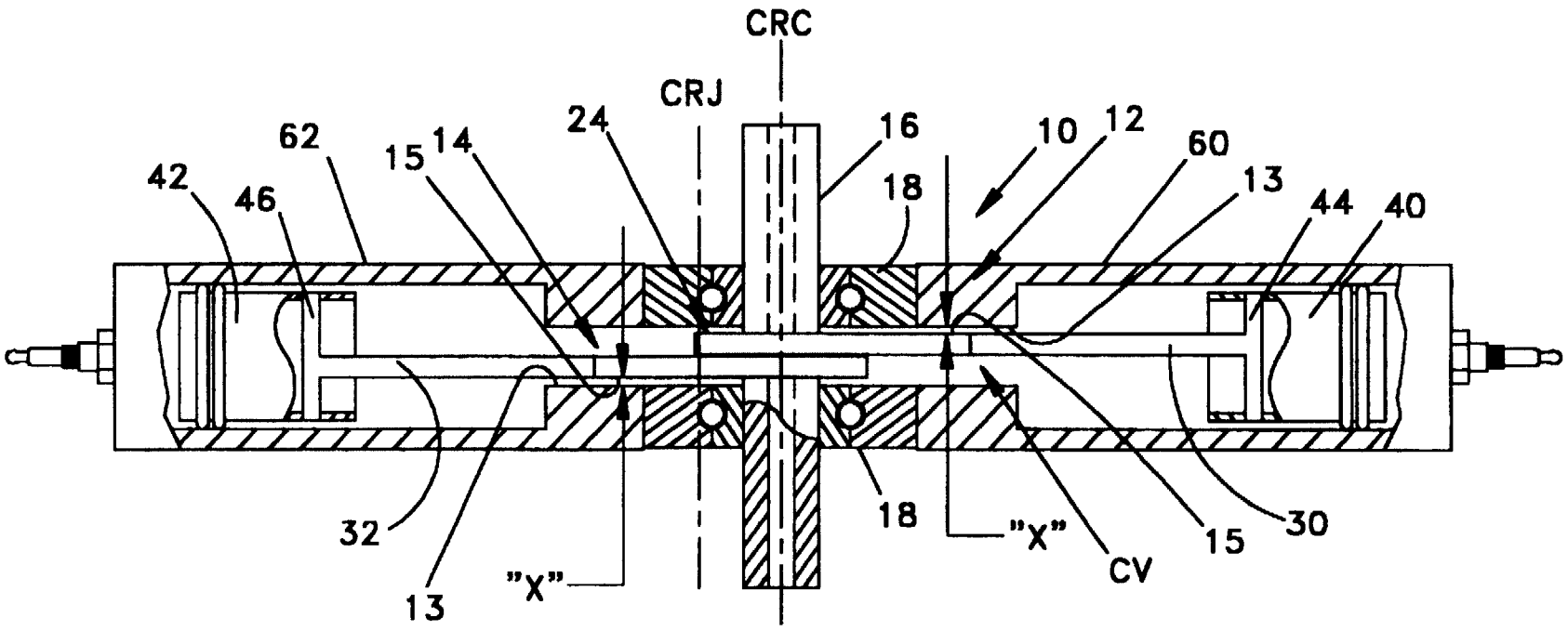
FIG. 2 is a sectional top view of the engine as illustrated in FIG. 1 wherein portions are cut away to illustrate the internal parts thereof.

Referring now to the drawings, the basic components of an internal combustion engine are illustrated in FIGS. 1 and 2 by the numeral 10. As best illustrated in FIG. 2, the internal components of the engine 10 are supported by a crankcase 12 having a crankcase volume CV. A crankshaft and connecting rod assembly, is indicated by the numeral 14. A main shaft 16 having a center of rotation CRC is rotatably mounted in the crankcase 12 by main bearings 18. As best illustrated in FIG. 1, a pair of disks are attached to the main shaft 16 in opposing and concentric relation thereto to form connecting rod journals 20, 22 and thus the formation of an eccentric crankshaft 24. The journals 20, 22 include journal bearing surfaces 26, 28, respectively and have a center of rotation CRJ. To maximize the strength of the crankshaft, the connecting rod journals 20,22 are axially positioned in face to face contact with one another, and are rigidly attached to one another as well as to the main shaft 16. The connecting rods 30,32 are rotatably attached to journals 20, 22, respectively. Connecting rods 30, 32 include rod bearings 34, 36, respectively, which interface with journal bearing surfaces 26, 28, respectively. Connecting rods 30, 32 are attached to piston pins 44, 46, respectively, of pistons 40, 42. Thus, it will be understood that the crankshaft and connecting rod assembly 14 includes the pistons 40 and 42. As noted in FIG. 2, the connecting rod journals 20, 22 and consequently the rods 30, 32 are positioned adjacent one another. This arrangement results in each rod being offset from the longitudinal center of its respective piston and piston pin. This offset permits longitudinal alignment of the laterally opposing pistons 40,42 and corresponding cylinders 60, 62. The connecting rods 30, 32 are typically retained in axial position by retaining means such as retainer plates (not shown) attached to the crankshaft. If desired, crankcase walls 13 may be utilized to retain the rods 30, 32 in the required axial position.

In analysis of the dynamic behavior of a crankshaft its torsional stiffness is a paramount consideration. In this regard, the torsional spring constant of the crankshaft must be made as great as possible to minimize destructive torsional resonance effects. Two configuration techniques are basic to increase these spring constants. One is to increase the cross-sectional area of the crankshaft normal to its rotational axis. The other is to decrease the length along the axis of the crankshaft. As is obvious from the configuration of the crankshaft and rod assembly 14, and its cooperation with the closely positioned main bearings 18, the present invention optimizes each of these techniques.

In the present invention, the center of rotation CRC of the eccentric crankshaft lies within the perimeters of each of the connecting rod journals 20,22; the peripheries being defined by the journal bearing surfaces 26, 28. This arrangement makes possible the formation of a straight passage 50 through the entire crankshaft along the crankshaft center of rotation CRC. The straight passage 50 has potential uses which include providing access from the rear of the engine to a driven load such as a variable pitch propeller at the front thereof.

As illustrated in FIG. 1, the weight of the crankshaft may be reduced by providing holes 48 in journals 20, 22. Such holes are radially displaced from the center of rotation of the shaft and are positioned in accordance with related design parameters. While these holes are typically parallel to the axis of rotation, such an alignment is not required.

Because of the connecting rod journal arrangement, the entire main shaft 16 can be made straight and continuous in a manner not possible with a conventional crankshaft. This design also permits the manufacture of the eccentric crankshaft 24 of a given weight of material to be made more resistant to bending than a conventional crankshaft of like weight.

Because the eccentric crankshaft 24 is very short, the main bearings 18 are positioned closer together than would be possible in a conventional engine. This further minimizes bending in the crankshaft.

Incorporation of the eccentric crankshaft 24 into the opposed twin cylinder engine 10, permits a relatively short separation distance between the opposing pistons 40, 42. This feature suppresses vibration caused by the couple formed by the inertial forces of the pistons 40, 42 and the extent of the separation between them. This close longitudinal spacing of the pistons typically eliminates or drastically reduces the necessity for counterbalance weight on the crankshaft. Thus manufacture of the crankshaft is simplified and its weight reduced.

The geometry of the eccentric crankshaft 24 encourages the design of a compact crankcase 12 having a very small volume CV. This configuration has potential for use as a crankcase-supercharging engine wherein the crankcase air is used to charge the cylinders. In such an engine, a crankcase of minimum volume is most efficient for delivering supercharging air to the cylinders. To maintain a minimum volume within the crankcase 12 a maximum clearance X is maintained between the inner wall 13 of the crankcase 12 and the rotatable components within the crankcase 12. Thus, the clearance X denotes the clearance between crankcase inner wall 13 and any internal moving component 15 or a portion thereof which may be nearest the inner wall 13 of the crankcase 12 in any given position of rotation of the components within the crankcase. As an example, in FIG. 2 the connecting rod journals are the components nearest to the crankcase wall 13, and as such are designated with the numeral 15. In the present invention this clearance X is maintained at a maximum of 0.1 inch.

Because of the relatively large diameter of journals 20, 22, the bearing width of these journals can be dramatically reduced without reduction in the bearing area provided in a journal of conventional design.

It is understood that a preferred embodiment of the present invention is disclosed which achieves the objectives of the invention as set forth above. However, it should be appreciated that this invention may be implemented in types of equipment other than those disclosed. Variations may also be made with respect to the best mode of practicing this invention without departing from the scope of the invention as set forth in the appended claims.

I claim:

1. An internal combustion engine comprising:

a main shaft having a main shaft center of rotation and two spaced apart main bearings concentric with said main shaft center of rotation and a straight passage formed around said center of rotation and passing through said main shaft;

a connecting rod journal attached in eccentric relation to said main shaft intermediate said main bearings and encircling said main shaft center of rotation, and having a rod journal center of rotation spaced radially apart from said main shaft center of rotation;

a connecting rod rotatably attached at one end thereof to said connecting rod journal and rotatbly attached at the distal end thereof to a piston.

2. An internal combustion engine having a pair of opposing and longitudinally aligned pistons and cylinders;

a crankcase interconnecting said cylinders and having an inner crankcase surface;

a crankshaft rotatably mounted at each end thereof to said crankcase and having a crankshaft center of rotation;

a pair of opposing eccentric connecting rod journals each having bearing surfaces thereon, each said connecting rod journal being rigidly attached to said crankshaft, and having an outer periphery thereof surrounding the center of rotation of said crankshaft;

a pair of connecting rods, each connecting rod of said pair of connecting rods being rotatably attached at one end thereof to one of said pair of connecting rod journals and rotatably attached at the distal end thereof to one piston of said pair of pistons.

3. An internal combustion engine as set forth in claim 2 wherein said crankshaft includes a straight passage along said crankshaft center of rotation and passing through said crankshaft.

4. An internal combustion engine as set forth in claim 3 wherein said inner crankcase surface is spaced apart from said connecting rod journals and from said connecting rods a maximum of 0.1 inch.

5. An internal combustion engine as set forth in claim 4 wherein said pair of opposing eccentric connecting rod journals directly contact one another and are rigidly attached to one another.

6. An internal combustion engine comprising;

a crankcase having an inner surface, an outer surface and two spaced apart parallel walls having a bearing mounted in each said wall;

first and second cylinders attached to said crankcase in opposed relation to one another;

first and second pistons slideably mounted within each said first and second cylinders respectively;

a straight mainshaft having a center of rotation, and rotatably mounted through each of said bearings;

first and second circular disks attached to said main shaft in opposing eccentric relation to one another;

first and second connecting rods rotatably attached at one end thereof to said first and second circular disks respectively, and rotatbly attached at distal ends thereof to said first and second pistons respectively.

7. An internal combustion engine as set forth in claim 6 wherein said first and second opposed cylinders are longitudinally aligned.

8. An internal combustion engine as set forth in claim 6 wherein a maximum clearance of 0.1 inch is maintained between the inner surface of said crankcase and said first and second connecting rods, and between the inner surface of said crankcase and said first and second circular disks.

9. An internal combustion engine as set forth in claim 6 wherein each said first and second circular disk has a peripheral bearing surface and wherein each said bearing surface surrounds said main shaft.

10. An internal combustion engine as set forth in claim 6 wherein a straight passage is formed through said mainshaft along said center of rotation.

11. An internal combustion engine as set forth in claim 6 wherein each said first and second circular disks are adjacent and in contact with one another and wherein said first and second disks are attached to one another.

12. An internal combustion engine as set forth in claim 6 wherein each said first and second circular disks are adjacent one of said bearings in said crankcase.

13. An internal combustion engine as set forth in claim 6 wherein lightening holes are formed in each said first and second circular disks.

* * * * *